US006464836B2

(12) United States Patent
Cabrera y Lopez Caram

(10) Patent No.: US 6,464,836 B2
(45) **Date of Patent: *Oct. 15, 2002**

(54) VARIABLE HYDRAULIC PULSE DRAINAGE CYLINDER FORMER

(75) Inventor: Luis Fernando Cabrera y Lopez Caram, Cuernavaca (MX)

(73) Assignee: Smurfit Carton y Papel de Mexico S.A. de C.V., Polanco (MX)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/273,198

(22) Filed: Mar. 19, 1999

(65) Prior Publication Data

US 2002/0088591 A1 Jul. 11, 2002

(51) Int. Cl.[7] ..... D21F 1/04; D21F 1/60

(52) U.S. Cl. ..... 162/329; 162/323; 162/327; 162/357; 162/321

(58) Field of Search ..... 162/329, 323, 162/327, 357, 368, 212, 343, 344, 347, 308, 321

(56) References Cited

U.S. PATENT DOCUMENTS

| | | | | |
|---|---|---|---|---|
| 1,801,238 A | | 4/1931 | Norman | |
| 1,870,971 A | | 8/1932 | Sundstrom et al. | |
| 2,005,839 A | * | 6/1935 | Edge | 162/329 |
| 2,141,273 A | | 12/1938 | Kutter | |
| 3,021,899 A | | 2/1962 | Goldsmith | |
| 3,029,871 A | | 4/1962 | Hornbostel | |
| 3,051,233 A | | 8/1962 | Baxter, Jr. | |
| 3,091,563 A | | 5/1963 | Meyer | |
| 3,111,454 A | | 11/1963 | Tucker et al. | |
| 3,272,692 A | | 9/1966 | Hayes et al. | |
| 3,554,866 A | * | 1/1971 | Wynstra | 162/321 |
| 3,556,938 A | * | 1/1971 | Ohta et al. | 162/306 |
| 4,361,467 A | * | 11/1982 | Bubik et al. | 162/336 |
| 4,543,159 A | | 9/1985 | Johnson et al. | |
| 5,019,214 A | * | 5/1991 | Meinecke et al. | 162/301 |
| 5,830,322 A | | 11/1998 | Cabrera y Lopez Caram et al. | |
| 5,951,823 A | | 9/1999 | Cabrera y Lopez Caram et al. | |

OTHER PUBLICATIONS

International Search Report issued by European Patent Office for corresponding PCT application No. PCT/IB00/00297 mailed Jul. 5, 2000.

Written Opinion issued by European Patent Office for corresponding PCT application No. PCT/IB00/00297, mailed Dec. 12, 2000.

* cited by examiner

*Primary Examiner*—Stanley S. Silverman
*Assistant Examiner*—Dionne A. Walls
(74) *Attorney, Agent, or Firm*—Frommer Lawrence & Haug, LLP; Ronald R. Santucci

(57) ABSTRACT

A cylinder former having a variable hydraulic pulse whilst drainage, for use in papermaking comprising a drainage means comprising a cylinder mould and a contoured member adjacent the cylinder mould having a plurality of hills and valleys which force entrained liquid through the fiber suspension forming on the cylinder mould so as to improve sheet formation. A baffle is provided in the discharge portion of the former to prevent stock build-up therein.

22 Claims, 6 Drawing Sheets

VARIABLE HYDRAULIC PULSE DRAINAGE CYLINDER FORMER

FIELD OF THE INVENTION

The present invention is directed towards a cylinder former having a variable hydraulic pulse whilst drainage, for use in papermaking.

BACKGROUND OF THE INVENTION

Today there are numerous ways of forming continuously a sheet of paper or paperboard, for example the use of a number of separate forming sections. The capital cost required to install one of the multifoudrinier is high and sometimes the change is not feasible because of the total capital required. Accordingly, in certain applications, the use of a cylinder mould in formation is desirable.

The principle of sheet formation on a cylinder mould is as follows. A horizontal cylinder (cylinder mould) having a wire cloth surface is arranged to rotate approximately three quarters submerged in a container (vat) of paper stock so that a small arc of its circumference is above stock level. Water associated with the fibrous suspension drains through the wire cloth with the result that a layer of fibers is deposited on the surface. Drainage take place because of a difference in level between the stock in the vat and the back water inside the mould.

A moving felt (mould felt/making felt) is then pressed by means of a roll (couch roll) into a contact with the cylinder at approximately the top position. By doing this the layer of fibers that has formed on the wire screen is transferred to the mould felt which moves away from the forming screen with it. Once the web has been transferred, the wire of the cylinder mould is washed by sprays and re-enters into the fiber stock where a new web is going to be formed.

If a number of these units are placed in series, then a multi-ply web or sheet of paper is produced continuously. Each forming unit typically has its own supply of paper stock and a method of removing the drainage water from its interior so that, in effect, each cylinder mould is a separated web forming machine in itself.

Various types of cylinder mould or vat arrangements currently exist. In this regard, a typical cylinder mould is constructed around a cast iron core upon that are secured bronze supporting spokes known as spiders. The spiders support concentric rims, the outside peripherals of which are grooved in order to carry rods that are approximately 1 centimeter in diameter and approximately 3.5 centimeters apart parallel with the axis of the central shaft. A continuous wire is wound round the cylinder.

On this skeleton is commonly sewn a bronze or stainless steel backing wire. It is over this backing wire that the forming wire is stretched and secured.

Another type of arrangement is what is known as contraflow vat where the stock flows opposite to that of the rotation of the mould. In this regard, the stock from the flow distribution arrangement enters the side at the bottom of the vat, passes over a weir and then over a baffle, rising again to be fed into the vat circle via wing boards (butterfly) and a making board. The purpose of the wing board is to help to correct the basis weight levels, when they have the tendency to be lighter or heavier on one side or the other.

In a uniflow vat, the basic components are essentially the same as for a contraflow vat, but the stock flows with the direction of the mould rotation.

In a dry vat situation, the dry vat has a seal introduced into the vat circle so that the fiber suspension is confined to a shorted section of a vat circle. Because the forming length has been reduced in size, the degree of uncontrolled turbulence is decreased.

In a restricted flow vat or half vat, it is essentially a dry vat with the unused half removed.

In the case of the contraflow vat, the stock enters the vat at considerable turbulence but in a short time becomes less turbulent and moves slowly through the vat towards the opposite side. This is the point where the forming surface of the mould enters the stock and where the major portion of the web formation is taking place. It is found that, in this zone, suspension is practically stationary and the stock is in an extremely flocculated state. Adjacent to the rotating mould surface a boundary layer is formed which moves rapidly in the direction of the cylinder rotation. The thickness of this layer depends on the consistency of the stock, its freeness and machine speed. Continued drainage without a corresponding fiber deposition leads to the consistency in this layer increasing to become substantially higher than that of the inlet stock. This stream of high consistency stock follows the cylinder surface to the point where the mould surface emerges. Here it mixes with the incoming stock and is recirculated to the other side of the cylinder thus increasing the consistency.

Between the two streams of stock mentioned above, an unstable layer is formed and localized differences in velocities are created which lead to a continuous exchange of stock between the two streams. This in turn leads to a non-uniform flow velocity and a non-uniform consistency across the machine that gives uneven conditions influencing both the web formation and the stock wash-off at the line of emergence.

In the case of the uniflow vat, at its inlet there is a turbulent flow that extends over the entire vat section, but this turbulence diminishes as the stock flows downward towards the center of the vat. It is during this first phase at the inlet that the rapid preliminary formation takes place. Some time later, when the flow velocity through the wire has decreased to a certain level, a boundary layer is formed that travels with and approximately at the velocity of the mould surface. This layer transports to the side of the vat a sufficiently large volume of stock to cause stagnation of other layers close to the walls of the vat. As in the case of the previously mentioned contraflow vat, wash-off takes place and results in the elevated consistency of the boundary layer. Where the mould surface leaves the stock, some thickened stock separates from the cylinder, some of this being discharged at the overflow while the remainder flows back downwards into the vat. The consistency of this stock is higher than that at the boundary layer. Counterflow and boundary layer are separated by an unstable intermediate layer through which thickened stock from the counterflow stream is fed back irregularly onto the boundary layer stream. This has a negative effect on web formation. The level differences between the vat and the inside cylinder level, the freeness, the machine speed and the amount of overflow control the intensity of the counterflow.

A rotoformer or sandy hill former consists of an open-ended perforated suction cylinder that is covered by a coarse backing wire and a fine face wire. Inside the cylinder are adjustable compartmented boxes into which drainage takes place under controlled conditions. There is also an initial draining zone at the beginning of web formation where draining is by means of gravity. The pond regulator can have its position adjusted in order to change the stock velocity and pressure applied at the initial forming zone.

The forming length is very short, 10 to 25 centimeters, while the drainage flow rate in the forming zone is very high limiting the basis weight and consistency that this former can handle.

A cylinder suction former consists essentially of a tapered stock inlet system from which tubes feed the stock to a dispersion chamber, followed by a top lid which can be adjusted on the run. Web formation takes place between the top lid and surface of the mould. The position of the suction box can be adjusted on the run. The forming length is very short, 10 to 25 centimeters, while the drainage flow rate in the forming zone is very high limiting the basis weight and consistency that this former can handle.

A short pressure former is a combination of a well-designed stock inlet with an explosion chamber feeding directly into a forming zone. The fiber suspension passes from a tapered inlet through a series of shear pipes into a small compartment, known as the explosion chamber, where the fiber dispersion takes place. Finally, the dispersed fibrous suspension passes to the forming zone where it is confined between a hinged lid and the mould surface. In this case, formation takes place under pressure. The forming length is very short, 10 to 25 centimeters. The drainage flow rate in the forming zone is very high limiting the basis weight and consistency that this former can handle.

Examples of some of the foregoing with modifications can be found in the following patents:

U.S. Pat. Nos:

1,801,238
1,870,971
3,021,899
3,091,563
3,111,454
3,272,692
4,543,159

While the types of cylinder mould arrangements as aforenoted have particular advantages, they also have attendant disadvantages some of which have certain been mentioned.

SUMMARY OF THE INVENTION

It is therefor a principal object of the invention to overcome the shortcomings of the devices heretofore mentioned.

It is a further object of the invention to provide for a hydraulic pulsing of the stock that is going to form the sheet to enhance stock distribution whilst also providing for drainage.

The formation of the sheet is the result of physical interaction during the forming process. There are three important hydrodynamic processes during the sheet formation. These processes are drainage, shear and turbulence.

The drainage process has two stages, one is filtration and other is thickening. Filtration is obtained when in the early part of the forming zone a high rate of water removal is achieved, the fines retention is high but shear is not present during this process. Thickening is obtained when small amounts of water are removed. During this process, fines retention is low.

The shear process is the result of controlling the differential speed between the stock flow and the forming (mould) machine. This process has to be controlled accurately or the final sheet will not have the desired properties.

The turbulence is present when the fibers in the stock flow are well dispersed at any consistency and the two hydrodynamic processes above described are present at the same time.

An additional objective of the invention is to provide the combination of the three aforementioned hydrodynamic processes in one forming zone and all of them interacting at the same time, the design of the forming zone will vary depending upon the particular operation.

In this regard, the present invention provides for a cylinder mould former which utilizes an adjustable contoured section in its forming zone. The contoured section provides for control over the ratio between the fiber suspension velocity and the cylinder mould velocity. The MD/CD ratio of the paper improves and becomes lower which is similar to that of a fourdrinier paper machine. At any given position of the contoured section, the fiber suspension flow is subject to continuous hydraulic pulses so the water is forced to pass in and out of the mould. The contoured section is graduated so as to eliminate flow separation due to shear at the boundary layers. The sheet formation occurs as a result of the gently pulsation of the stock slurry and the gradual removal of water as the water/fiber mixture moves towards the discharge lip near the top of the cylinder. This process will decrease or eliminate the filtration process, thus uniformly distributing fines across the thickness of the newly formed sheet. In addition, a baffle arrangement is provided to avoid stock build-up at the bottom of the former.

DETAILED DESCRIPTION OF THE INVENTION

Figure 1:
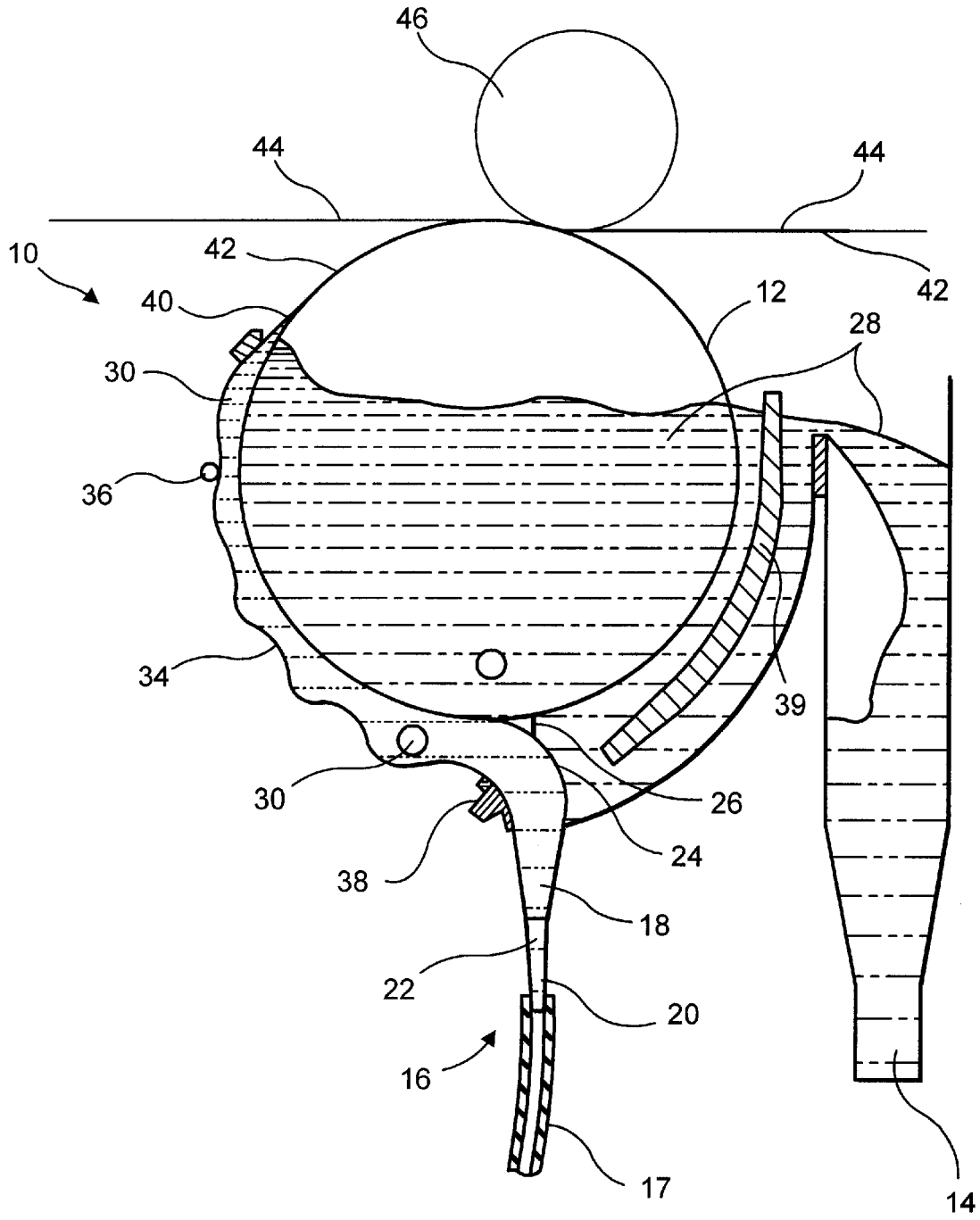
FIG. 1 shows a cross sectional view of the inventive former.

FIG. 1 shows a cross sectional view of a preferred embodiment of the former. Former 10 includes a cylinder mould 12 which is coupled with a drainage outlet 14 which includes a fan pump (unseen) which sends the stock to the former and receives the entrained liquid from the cylinder mould 12. The general generic operation of the former 10 is along the lines of those previously discussed. A paper stock inlet 16 is provided and may comprise a series of shear hoses in the cross machine direction which feeds paper stock 20 from a distributor (unseen). The paper stock 20 fed through shear hoses 17 is subject to an explosion chamber 18. The former 10 further comprises a baffle 24 and a seal 26 to prevent the water drained through mould 12 from entering the forming zone 32. When paper stock 20 encounters baffle 24 and seal 26, the water 28 is separated from paper stock 20 to form a fiber suspension 30. Fiber suspension 30 is then passed to a forming zone 32 (FIG. 2) which further comprises an adjustable contoured section lip 34 adjacent to the cylinder mould surface 12. Adjustable contoured section lip 34 has one hinged side 36 to allow for adjustment of distances from the cylinder mould 12 and the other side an adjustable sliding mechanism 38 for rush/drag adjustment producing a paper web with MD/CD ratio control similar to a fourdrinier paper machine. In this regard, the sliding mechanism 38 allows the contour section lip 34 to be adjusted in an angular basis from the pivot point 36, by doing this operation the contour section lip 34 will be adjusted at various distances from the cylinder mould 12 because of the radial distances from the hinge point 36 and the seal mechanism 38 as well as the angular movements of the contour section lip 34. The distance from the contour section lip 34 to the cylinder former 12 will change (increase) because of the radial distance from the hinge point 36. This operation will allow to control in a very precise manner the rush drag ratio and drainage of the stock, controlling the hydraulic pulses.

Also, adjusting the contour section 34 provides control over the ratio between the fiber suspension velocity and the cylinder mould 12 velocity. This allows one to control the amount of water remaining in the fiber suspension 30.

The drain water 28 will flow through the cylinder mould 12, and out of the cylinder mould 12 towards a baffle 39 located on the discharge side. Baffle 39 is curved and extends in the cross-machine direction substantially co-extensive with the width of the cylinder mould 12. Drain water 28 will follow the cylinder mould 12 rotation, as shown by the arrows in FIG. 3. The excess water will exit at the port between the baffle 39 and the seal 26–24. This process avoids the stock from build up at the bottom of the former eliminating the possibility of any plug or cylinder mould 12 jam by providing a scouring effect.

Figure 2:
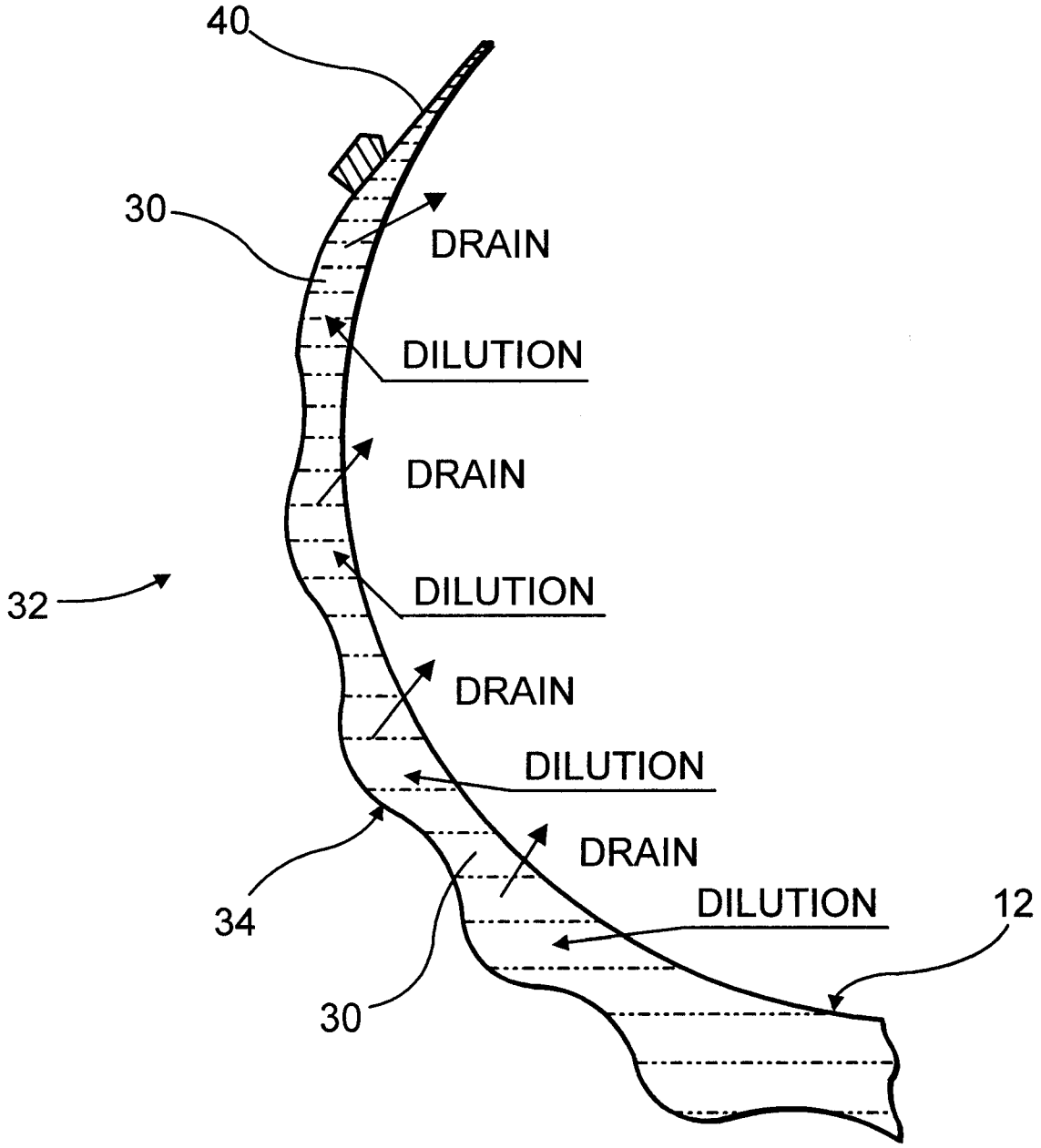
FIG. 2 shows an enlarged cross sectional view of the forming zone of the inventive former of FIG. 1.

Turning now more specifically to FIG. 2, it shows forming zone 32 in greater detail. At any given position on the adjustable contoured section lip 34, the fiber suspension 30 is subject to continuous hydraulic pulses forcing the water to pass in and out of the mould 12 through the series of hills and valleys. The remaining water is drained from the contour section 34 to a flat section 40 to form a sheet of paper 42. This flat section can also be a curved lip which follows the shape of the cylinder.

In FIG. 1, a felt 44 is then pressed by means of a couch roll 46 into a contact with the cylinder mould 12 at approximately the top position. By doing this the layer of fibers forming the sheet of paper 42 that has formed on the wire screen is transferred to the felt 44 which moves away from the forming screen with it.

Figure 3:
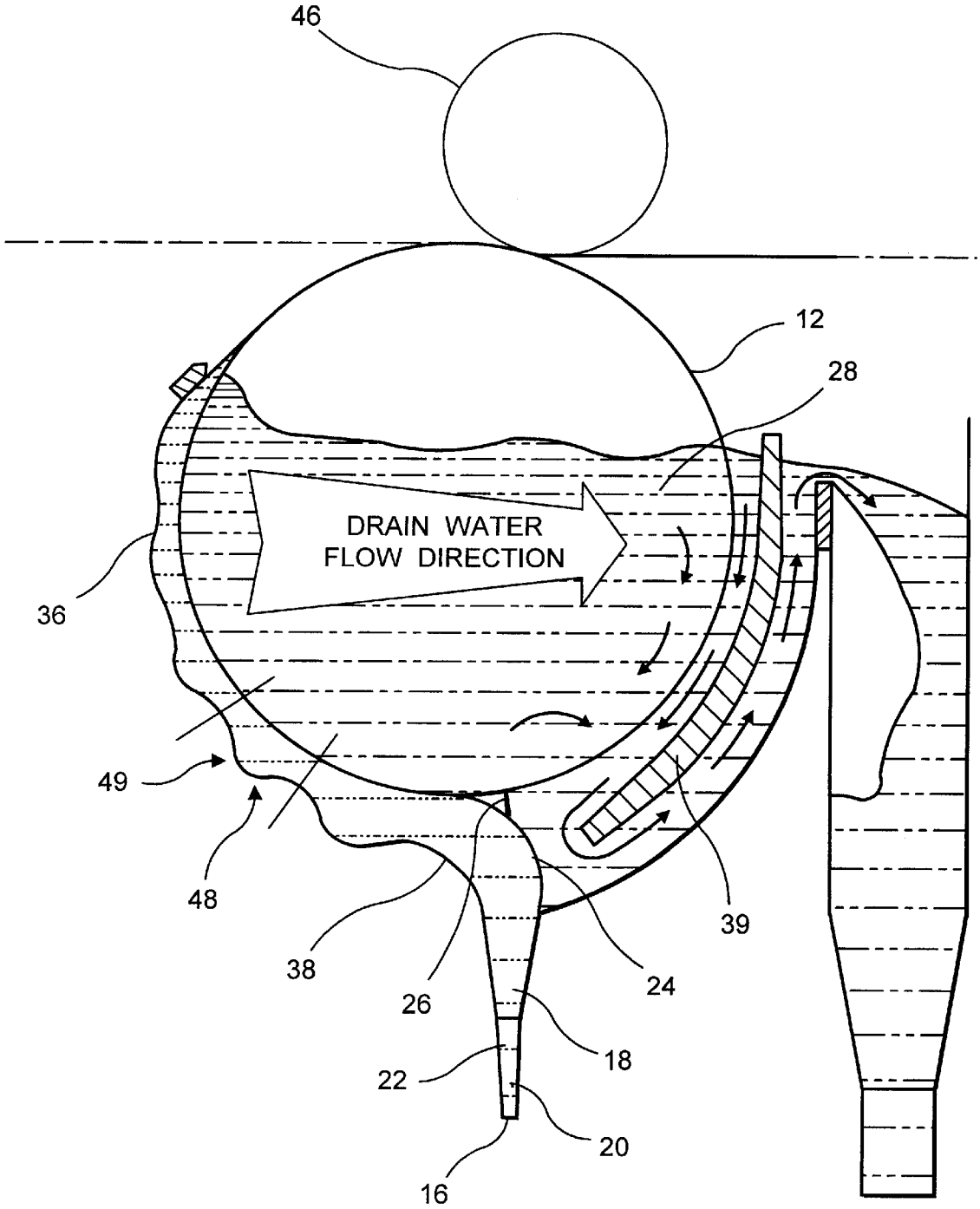
FIG. 3 shows an enlarged cross sectional view of the adjustable contoured section of the inventive former of FIG. 1.

FIG. 3 shows in detail the dilution zone 48 where fiber dispersions takes place and the drainage zone 49 where shear effect in boundary layers is generated. The combination of these two processes will produce a sheet of paper well-formed, free of flocks and will allow higher stock loading per former.

Figure 4B:
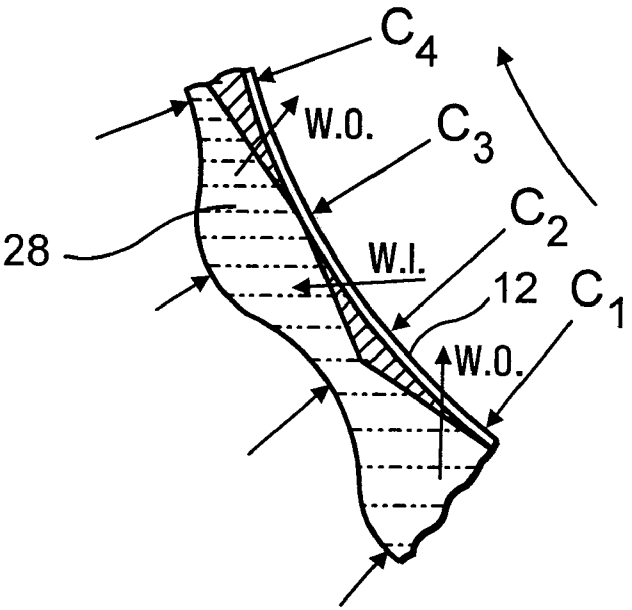
FIGS. 4*a* and 4*b* show a schematic of the principle of operation of the former.
Figure 4A:
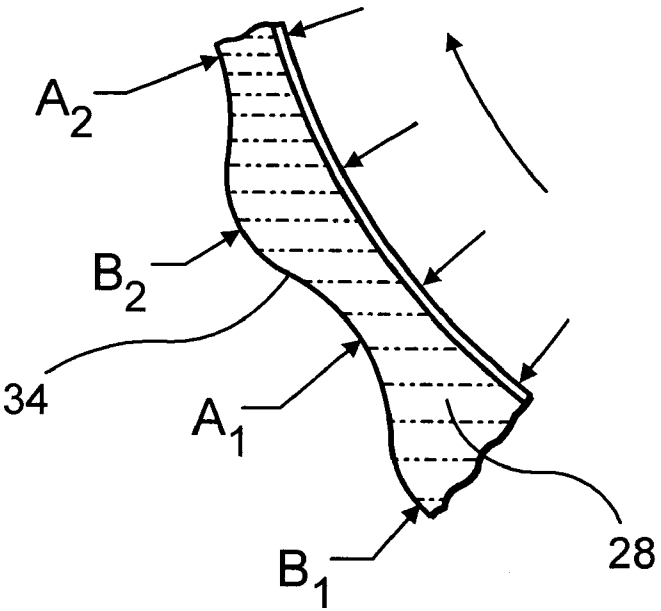

The principle of operation of the improved former is that in the area between the contoured section lip 34 and the cylinder mould 12, the large distances $B_1$, $B_2$, . . . $B_n$ therebetween is in continuous reduction as well as to the distances $A_1$, $A_2$, . . . $A_n$ as shown in FIGS. 4*a* and 4*b*. The pressure differential forces water 28 back to the cylinder mould 12 and forces fiber suspension 30 through the system as shown in FIG. 4*b*. The shape of the adjustable contoured section lip is designed in such a manner that flow separation at the boundary layers between the adjustable contoured section lip 34 is minimized or otherwise eliminated.

Such design considerations may be in accordance with the following:

Let C be the cord from 0 to 1

Angular Increments every 5 degrees

θ=0 . . . 180

Equation to find x every 5 degrees increments $$X = \left[\frac{c}{2} * \left(1 - \cos\left(\frac{\theta * \pi}{180}\right)\right)\right]$$

Equation Yt evaluated $$\begin{aligned} Yt = {} & 1.4845 \cdot t \cdot \mathrm{SQRT}[.437 * c * (1 - \cos(\theta * \pi / 180)) - \\ & 8.79 * 10^{-2} * c^2 * (1 - \cos(\theta * \pi / 180))^2 + \\ & 3.55375 * 10^{-2} * c^3 * (1 - \cos(\theta * \pi / 180))^3 - \\ & 6.34375 * 10^{-3} * c^4 * (1 - \cos(\theta * \pi / 180))^4] \end{aligned}$$

$$Yc = \left[\frac{m}{p^2} * \left[2 * p * \left[\frac{c}{2} * \left(1 - \cos\left(\frac{\theta * \pi}{180}\right)\right)\right] - \left[\frac{c}{2} * \left(1 - \cos\theta * \frac{\pi}{180}\right)\right]\right]^2\right]$$

m=Maximum ordinate p=Cordwise position of maximum ordinate

Xc value is calculated as follows $$Xc = \left[\frac{c}{2} * \left(1 - \cos\left(\frac{\theta * \pi}{180}\right)\right)\right] - Yt * \sin(\theta)$$

Y1 value is calculated as follows $$Y1 = Yc + Yt * \cos(\theta)$$

One section of the contour lip profile is the result of plotting Xc vs. Y1

The stream line that defines the contour lip is depending on the specific speed of the application and is as follows:

$$\psi = U * y = \frac{q * \theta}{2\pi}$$

$$Y = U * \left[\frac{c}{2} * \left(1 - \cos\left(\frac{\theta * \pi}{180}\right)\right)\right] * \sin\left(\frac{\theta * \pi}{180}\right)$$

U is the velocity at any given point q is the mean velocity of the media

Accordingly, sheet formation occurs as a result of the gentle pulsation of the stock slurry and the gradual removal of water as the water/fiber mixture moves towards the discharge lip near the top of the cylinder mould 12. The process decreases the speed of the filtration, thus uniformly distributing fines across the thickness of the newly formed sheet. The advantages of the improved former results in paper having an MD/CD ratio similar to an fourdrinier machine. There is also an increase in the basis weight capacity over that of prior formers; improvement in the paper formation at any capacity thus improving quality; increase in production capacity; in addition to a lower capital investment in comparison to prior art formers.

Figure 5:
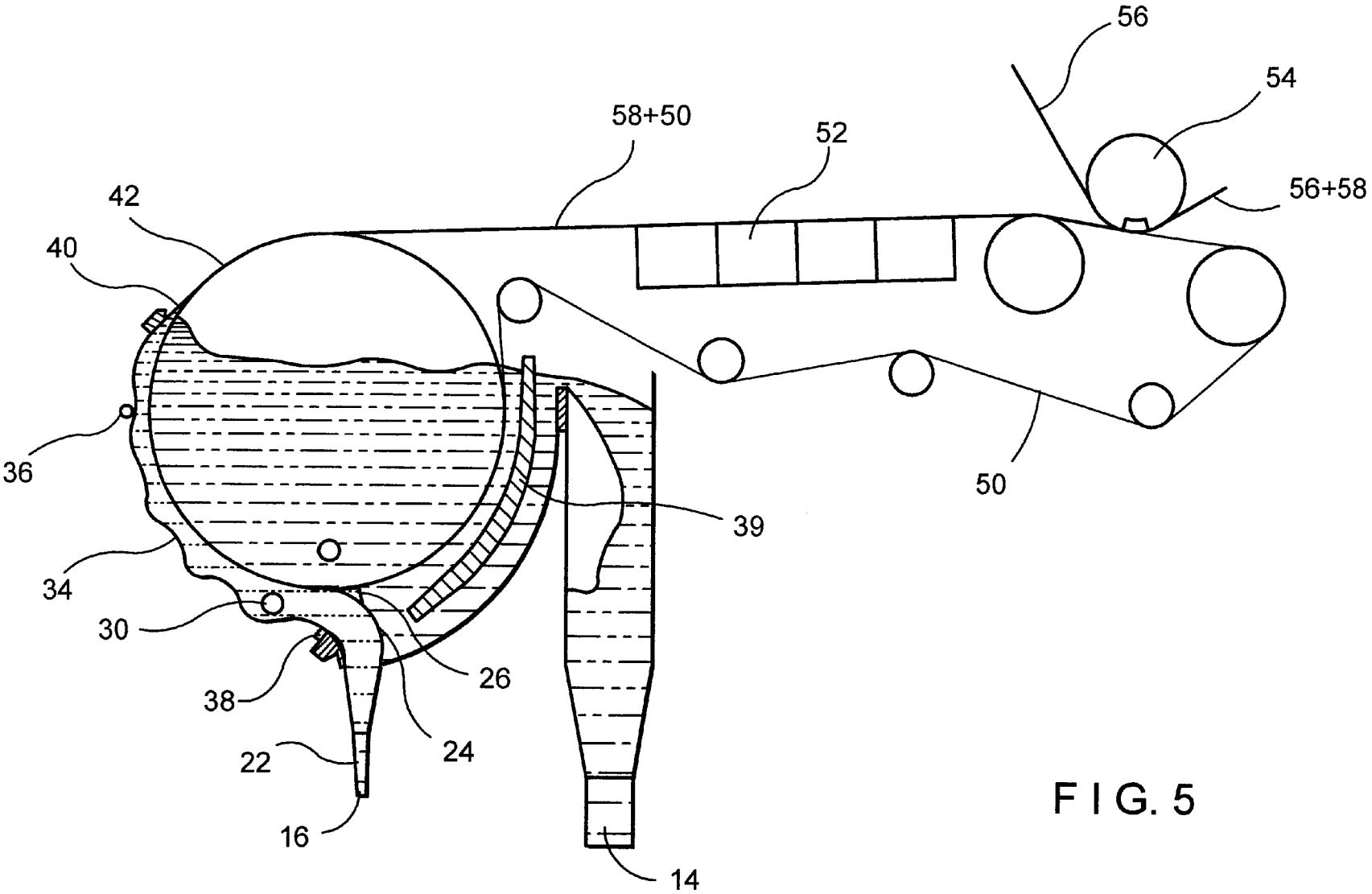
FIG. 5 shows an alternative embodiment of the present former.

The operation of the above embodiment may be enhanced by the use of an alternative embodiment shown in FIG. 5 which further comprises a forming wire 50, vacuum flat boxes 52, pick up roll 54 and transfer felt 56. The water remaining in the fiber sheet 58 is further drained by way of vacuum boxes 52, to reach a desired dryness. After the formed sheet 58 is fed over vacuum boxes 52, the felt 56 is fed through pick up roll 54 which will remove the formed sheet 58 for further processing. The alternative embodiment has the benefit of being able to increase the load of the former 10 without loss of paper quality or additional energy consumption.

Figure 6:
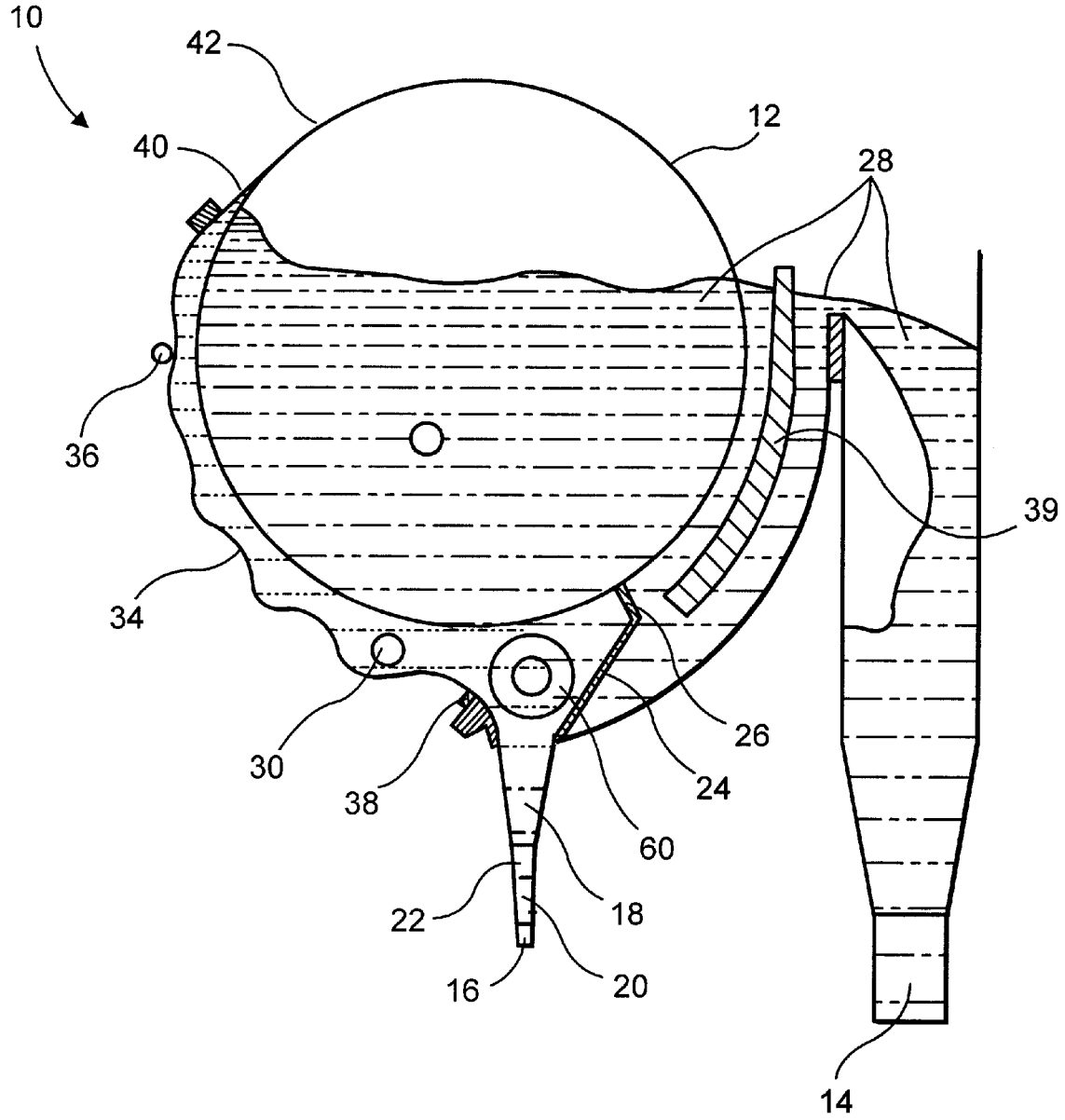
FIG. 6 shows an alternative embodiment of the present former.

An second alternate embodiment is shown in FIG. 6. The former 10 further comprises a mixing roll 60 near the baffle 24 and at a point where a high consistency stock flows from the stock inlet 16. This rotating mixing roll 60 disperses the stock and so that the former 10 may use high consistency stock (2 to 4%) from the distributor. The mixing roll 60 disperses the fibers reusing the water that is presently inside the cylinder mould. The additional benefit of this embodiment is the reduction of the energy and size of the fan pump used to feed stock to the former 10.

Thus by the present invention its advantages will be realized and although preferred embodiments have been disclosed and described in detail herein, its scope should not be limited thereby rather its scope should be determined by that of the appended claims.

What is claimed is:

1. A cylinder former having a variable hydraulic pulse whilst drainage, for use in papermaking comprising:

a drainage means comprising a cylinder mould; and a contoured member adjacent the cylinder mould having a plurality of hills and valleys which force entrained liquid to pass in and out of the cylinder mould through a fiber suspension forming on the cylinder mould so as to improve sheet formation.

2. A cylinder former according to claim 1 further comprising a baffle and a seal to prevent the water drained through the cylinder mould from entering the forming zone.

3. A cylinder former according to claim 1 wherein the contoured member comprises a hinged side and a sliding side to provide control over the ratio between fiber suspension velocity and the cylinder mould velocity.

4. A cylinder former according to claim 1, further comprising a discharge portion for discharging drained water from the cylinder mould, a baffle position in said discharge portion adjacent said cylinder mould wherein rotation of the cylinder mould causes drained water to flow around the baffle providing a scouring effect.

5. A cylinder former in accordance with claim 4 wherein said baffle is curved and substantially coextensive with the cylinder mould in the CD direction.

6. A cylinder former according to claim 1 wherein the contoured member includes a flat or curved section from which a formed sheet exits.

7. A cylinder former according to claim 1 further comprising a mixing roll adjacent a stock inlet to the cylinder mould for mixing stock to disperse fibers therein.

8. A cylinder former according to claim 1 further comprising a felt positioned above the cylinder mould to receive a sheet formed from the fiber suspension.

9. A cylinder former according to claim 1 further comprising a discharge portion for discharging excess drained water from the cylinder mould, a baffle position in said discharge portion adjacent said cylinder mould wherein rotation of the cylinder mould causes drained water to flow around the baffle providing a scouring effect.

10. A cylinder former according to claim 9 further comprising a discharge portion for discharging excess drained water from the cylinder mould, a baffle position in said discharge portion adjacent said cylinder mould wherein rotation of the cylinder mould causes drained water to flow around the baffle providing a scouring effect.

11. A cylinder former according to claim 3 wherein the contoured member is adjustable.

12. A cylinder former having a variable hydraulic pulse whilst drainage, for use in papermaking comprising:

a drainage means comprising a cylinder mould; and a contoured member adjacent the cylinder mould having a plurality of hills and valleys which force entrained liquid to pass in and out of the cylinder mould through a fiber suspension forming on the cylinder mould so as to improve sheet formation;

a forming wire for recovering a formed sheet from the cylinder mould;

at least one vacuum flat box;

a pick up roll; and a transfer felt wherein water remaining in said sheet is further drained by way of the vacuum box to reach a desired dryness and the sheet is fed through the pickup roll where the transfer felt removes the sheet for further processing.

13. A cylinder former according to claim 12 further comprising a baffle and a seal to prevent the water drained through the cylinder mould from entering the forming zone.

14. A cylinder former according to claim 13 wherein the contoured member is adjustable.

15. A cylinder former according to claim 14 wherein the contoured member includes a flat or curved section from which a formed sheet exits.

16. A cylinder former according to claim 12 wherein the contoured member comprises a hinged side and a sliding side to provide control over the ratio between fiber suspension velocity and the cylinder mould velocity.

17. A cylinder former according to claim 12 further comprising a felt positioned above the cylinder mould to receive a sheet formed from the fiber suspension.

18. A method for forming a sheet of paper comprising:

a) feeding paper stock on a cylinder mould;

b) draining water through the cylinder mould from the paper stock to form a fiber suspension on the cylinder mould;

c) passing the fiber suspension to a forming zone comprising an adjustable contoured member having a plurality of hills and valleys which force entrained liquid to pass in and out of the cylinder mould through the fiber suspension, said contoured member being adjacent to the cylinder former; and d) draining water from the contoured member to form a sheet of paper.

19. The method according to claim 18 further comprising a discharge portion for discharging excess drained water from the cylinder mould, and providing a baffle position in said discharge portion adjacent said cylinder mould wherein rotation of the cylinder mould causes drained water to flow around the baffle providing a scouring effect.

20. A method for forming a sheet of paper comprising:

a) feeding paper stock on a cylinder mould;

b) draining water through the cylinder mould from the paper stock to form a fiber suspension on the cylinder mould;

c) passing the fiber suspension to a forming zone comprising an adjustable contoured member having a plurality of hills and valleys which force entrained liquid to pass in and out of the cylinder mould through the fiber suspension, said contoured member being adjacent to the cylinder former;

d) draining water from the contoured member to form a sheet of paper;

e) recovering the sheet of paper from the cylinder mould by means of a forming wire;

f) draining water from said sheet by means of at least one vacuum box to reach a desired dryness; and g) feeding the sheet through a pick up roll where a transfer felt removes the sheet for further processing.

21. The method according to claim 20 further comprising providing a discharge portion for discharging excess drained water from the cylinder mould, and providing a baffle position in said discharge portion adjacent said cylinder mould wherein rotation of the cylinder mould causes drained water to flow around the baffle providing a scouring effect.

22. A cylinder former having a variable hydraulic pulse whilst drainage, for use in papermaking comprising:

a drainage means comprising a cylinder mould; and a contoured member adjacent the cylinder mould having a plurality of hills and valleys with a continuous reduction in distance between the hills and valleys and the cylinder mould which force entrained liquid to pass in and out of the cylinder mould through a fiber suspension forming on the cylinder mould so as to improve sheet formation.

* * * * *